US005896717A

United States Patent [19]

Gill

[11] Patent Number: 5,896,717

[45] Date of Patent: Apr. 27, 1999

[54] STRUCTURE OF INTERLOCKING MEMBERS

[76] Inventor: Norman Douglas Gill, 21 Widney Close, Bentley Heath, Knowle, Solihull, B93 9AS, United Kingdom

[21] Appl. No.: 08/802,112

[22] Filed: Feb. 19, 1997

Related U.S. Application Data

[63] Continuation of application No. PCT/GB95/01794, Jul. 31, 1995.

[30] Foreign Application Priority Data

Aug. 19, 1994 [GB] United Kingdom ..... 9416852

[51] Int. Cl.[6] ..... E04B 1/61

[52] U.S. Cl. ..... 52/586.2; 52/223.7; 52/461; 52/592.1; 52/779; 52/762; 52/766; 52/800.12

[58] Field of Search ..... 52/586.2, 586.1, 52/582.1, 590.1, 482, 762, 766, 768, 779, 584.1, 589.1, 590.2, 592.2, 763, 764, 780, 800.1, 800.11, 800.12, 461, 223.6, 468, 223.7, 469

[56] References Cited

U.S. PATENT DOCUMENTS

| | | |
|---|---|---|
| 3,182,769 | 5/1965 | De Ridder . |
| 3,886,705 | 6/1975 | Cornland . |
| 4,201,024 | 5/1980 | Lafitte, Jr. . |

FOREIGN PATENT DOCUMENTS

| | | |
|---|---|---|
| 2 102 706 | 4/1972 | France . |
| 2 194 291 | 2/1974 | France . |
| 2 520 483 | 7/1983 | France . |
| 2 335 705 | 2/1974 | Germany . |
| 42 42 530 | 6/1994 | Germany . |
| 479 784 | 10/1969 | Switzerland . |
| 504 339 | 3/1971 | Switzerland . |
| 1 288 454 | 9/1972 | United Kingdom . |
| 1 438 598 | 6/1976 | United Kingdom . |
| 1 567 161 | 5/1980 | United Kingdom . |
| 2 083 342 | 3/1982 | United Kingdom . |
| 2 117 813 | 10/1983 | United Kingdom . |
| WO 96/06241 | 2/1996 | WIPO . |

*Primary Examiner*—Robert Canfield
*Attorney, Agent, or Firm*—Young & Thompson

[57] ABSTRACT

A structure of two interlocking members, such as two planks, comprises a first member having a pair of first rectilinear location edges and a second member having a pair of second rectilinear location edges, each first location edge comprising a pair of elongate flange formations which define therebetween an elongate recess and each second location edge having a tongue formation to engage in a respective recess of a first member by relative angular movement of the members, each flange formation of a first member comprising a longitudinally extending undercut zone and each tongue formation of each second member comprising a protrusion which is received in an undercut zone of one of the flange formations in an assembled condition of the members.

3 Claims, 4 Drawing Sheets

STRUCTURE OF INTERLOCKING MEMBERS

This is a continuing application of international application PCT/GB95/01794 filed Jul. 31, 1995, which designated the United States.

FIELD OF THE INVENTION

The present invention relates to a structure of interlocking members and in particular, though not exclusively, to a structure in which at least one of the members is in the form of a panel, the term "panel" being used herein to embrace an elongate type panel in the form of a plank.

BACKGROUND OF THE INVENTION

An example of a known technique for forming a joint assembly between two panels is described in GB-A-2117813. That document describes the use of a pair of strips secured to the edges of respective panels, for example by a dovetail joint. The connecting strips are provided one with a curved tongue and the other with a groove. One strip can be pivoted relative to the other for the tongue to enter the groove.

The structure of the present invention may comprise an assembly of two or more panels in which two panels are interlocked by an interposed connection member, or an assembly in which two panels are directly interconnected.

In one of its aspects the present invention seeks to provide a structure in which a pair of members, such as a panel and another member, or two panels, may be interconnected, and may subsequently be selectively separated in a controlled manner.

SUMMARY OF THE INVENTION

According to one aspect of the present invention a structure comprises a first member having a first rectilinear location edge and a second member having a second rectilinear location edge for lying interlocked with said first rectilinear location edge of the first member, the first rectilinear location edge comprising a pair of elongate flange formations which define therebetween an elongate recess, the length direction of the elongate formations and the recess being the length direction of the first rectilinear location edge, said second rectilinear location edge having a tongue formation adapted to be located in said elongate recess by relative movement of the first and second members in a direction substantially perpendicular to the length direction of said elongate recess, and retention means to resist separation of the interlocked location edges in at least a first direction of separation, said structure comprising a plurality of said first members and a plurality of said second members with each second member arranged to lie interposed between and to interconnect two successive first members, each first member having a pair of first rectilinear location edges each comprising a pair of elongate flange formations, each second member having a pair of second rectilinear location edges each comprising a tongue formation, each of the flange formations of a pair at each said first rectilinear location edge comprising a longitudinally extending undercut zone and each tongue formation of each said second rectilinear location edge comprising a protrusion which is received in the undercut zone of one of said flange formations of a pair in an assembled condition of the members.

Preferably the tongue formation and elongate recess are shaped to allow them to be brought together to an interlocked condition, and optionally also to be separated, without any substantial deformation of either of the members or substantial relative friction therebetween. Thus it is envisaged that the tongue formation shall be substantially freely received in the elongate recess and hence, even though the interlocking location edges may be of substantial length, they can nevertheless be brought together into an interlocked configuration without the need for application of substantial force.

The invention requires that the two members are interlocked by relative movement in a direction substantially perpendicular to the length of the elongate recess, i.e. the length directions of the location edges, and thereby avoids the need for relative lengthwise sliding movement. A structure can therefore be assembled in a confined space.

It is envisaged that said direction of relative movement may be an angular movement comprising rotation about an axis or axes parallel with the length directions of the location edges. Thus during that relative rotation at least a part of the location edge of one member (as viewed in transverse cross-section) will move relative to the other location edge in a direction which comprises a component that is substantially perpendicular to the length of the recess. When rotated to an interlocked position, the elongate recess and tongue formation may interengage to serve as said retention means and resist direct separation of the members, at least in a first rectilinear direction which is perpendicular to the length of the recess.

Auxiliary means, which is additional to said members, may be provided as retention means to retain the members in a selected position of angular alignment at which they lie interlocked to resist a direct separation.

The first location edge having a pair of elongate flange formations may be provided with a pivot formation over the surface of which a part of the second location edge may slide, and be supported, during relative angular movement of the members to an interlocked configuration. That pivot formation may be provided by one of the elongate flange formations.

One flange formation of a pair may serve primarily only to prevent relative transverse movement of the members in a direction perpendicular to that direction in which separation of the members is prevented by the interlock.

The structure may be a free standing structure such as a partition or may comprise a frame, e.g. of a building, to which the panels are connected. The structure may comprise a frame having frame members which interconnect with some of the tongue formations and elongate recesses of the panel and other type members thereby to provide or add to the rigidity of the structure.

A frame member or other component of the structure may serve as a locking member and act as auxiliary retention means to extend transversely relative to said first and second members and interlock with an end of each of said first and second members. A tension member may extend longitudinally of the first and second members to hold the locking member interlocked with said ends of the first and second members. Two locking members, e.g. two frame members, may be provided and arranged respectively to lie interlocked with respective ends of the first and second members. In an alternative construction a tension member may be arranged to extend from a locking member, longitudinally of the first and second members, and connect to an anchor position such as a ground fixing. At least one of the first and second members may be hollow or formed with an internal passage through which the tension member may extend.

The structure may include a batten which is engaged with each of the aligned panels of a structure to act as auxiliary retention means which prevents the panels moving out of alignment with one another. The members are thereby maintained interlocked to resist separation. In the case of a connection between two co-planar panels, whether a direct connection or one achieved with a interposed connection member, the interlock preferably resists separation in a direction parallel with the plane of the panels and perpendicular to the interlocked location edges.

A batten for use as auxiliary retention means may comprise a channel member which receives the top or bottom edges of a plurality of aligned panels of one wall of a structure and, if desired, a pair of such battens may be provided, one at each of the top and bottom edges of the wall structure.

In the case of panels connected to a frame, alignment may be maintained by at least some of the panels being connected to the frame.

The structure may include a window or door opening as desired which may be bounded by further channel shaped members which receive edges of the panels and define the window or door opening.

According to a second aspect of the invention there is provided a building comprising at least one wall structure in accordance with the first aspect of the invention.

The building may comprise a frame, or may be frameless. The building may be a free standing building having preferably, four walls, or may be a lean-to building having only two, or three walls.

The building may comprise a roof being a structure in accordance with the first aspect of the invention. The roof may be generally flat or inclined to the horizontal, or may be pitched.

One or more of the interlocking members may be hollow. A member may have an internal cavity which may be filled, for example with a thermal insulation material. One or more of the interlocking members may be transparent.

A panel may comprise an outer skin which defines a cavity filled with insulation material. Part of the shape of the location edge may be defined by the insulation material or there may be a break in continuity of the skin so as to reduce any cold-bridging effect between opposite faces of the panel.

The invention further provides an assembly comprising a plurality of panels with the successive panels interconnected by connection members which in the assembly lie wholly or substantially wholly in confronting elongate recesses of the panels. A connection member may lie wholly concealed from external view or may, for example, have only a narrow rib portion, or a pair of rib portions, exposed; that rib portion optionally may be adapted to provide a decorative effect.

Suitable materials for the interlocking members include plastics materials and metals such as steel and aluminium.

BRIEF DESCRIPTION OF THE DRAWINGS

Embodiments of the present invention will now be described, by way of example only, with reference to the accompanying drawings in which.

DESCRIPTION OF THE PREFERRED EMBODIMENTS

Figure 1:
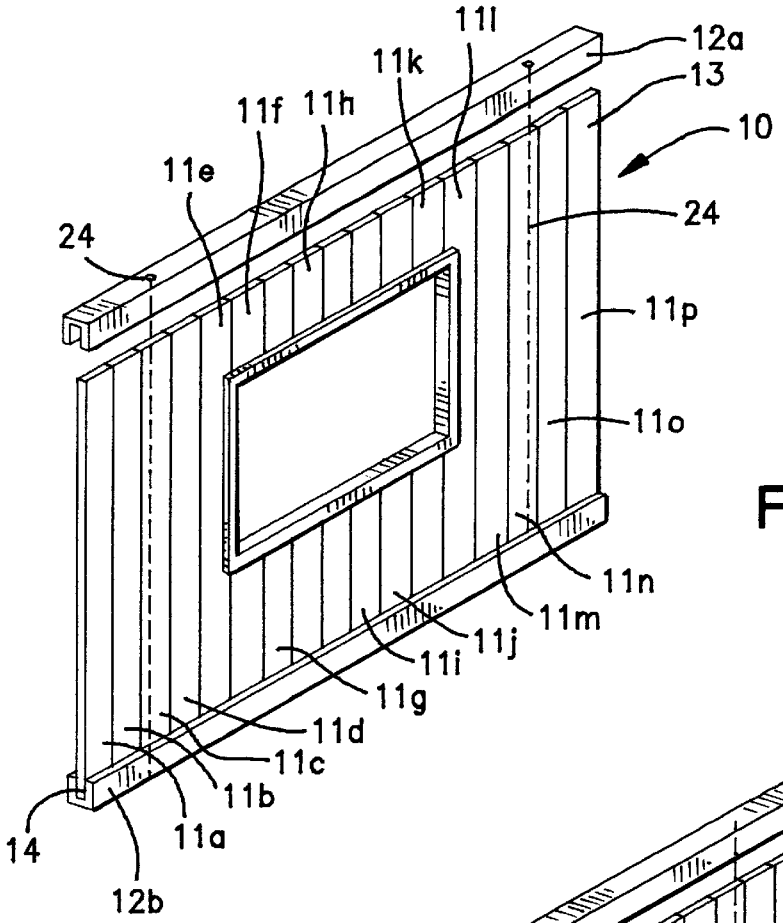
FIGS. 1 and 2 are illustrative views only of examples of structures in accordance with the present invention, which together form part of a building.

Referring to FIG. 1, a first embodiment of a structure in accordance with the invention comprises a wall 10 and has a plurality of interlocking members in the form of panels, some of which are indicated at 11*a*–11*p* and some of which are hollow.

The panels 11*a*–11*p* are interconnected edge to edge as hereinafter described when they are in alignment, alignment being maintained in the present example by interlock with a pair of battens 12*a* and 12*b*. In the drawing, batten 12*a* is shown separated from the remainder of the structure, from which it can be seen that each batten 12*a*, 12*b* is of a channel configuration, each receiving a respective top or bottom edge, 13, 14 of each of the panels 11*a*–11*p*.

Upper and lower battens 12*a* and 12*b* are secured against ends of the panels by cables 24 which extend between the battens through the cavities of hollow type panels.

If desired, battens may be provided at intermediate edges 13, 14 and may be engaged with each of the panels 11*a*–11*p* by fasteners. However, the arrangement shown is preferred as this avoids the need for any such fasteners.

In FIG. 1, a window opening 15 is shown provided in the wall, the window opening 15 being bounded by four channel-shaped members 16, 17, 18 and 19, each of which receives an edge of one or more of the panels 11*e*–11*l* to define the window opening 15.

Figure 2:
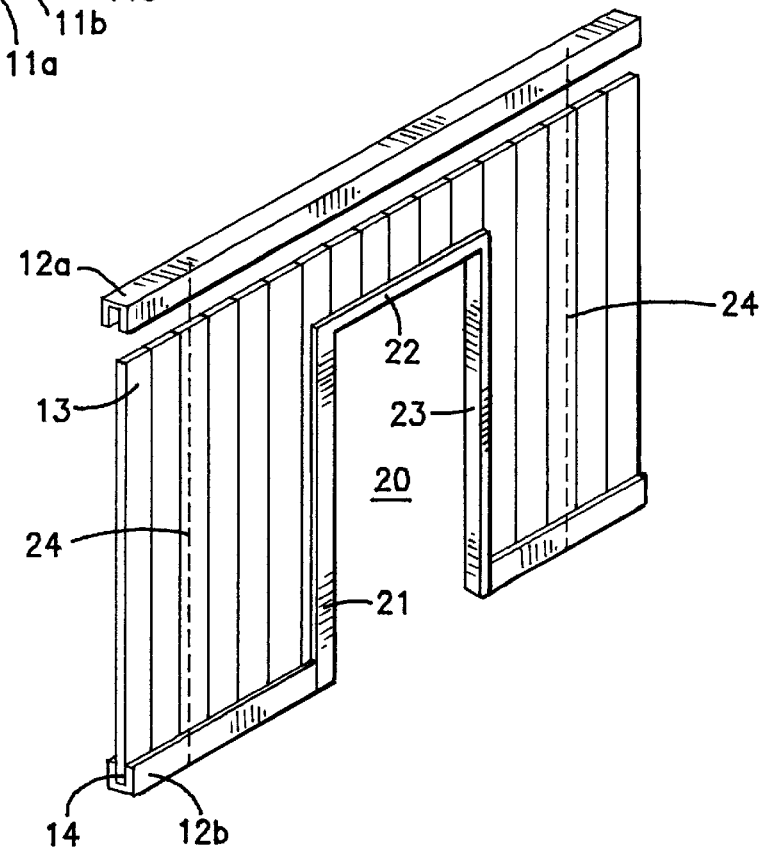

In FIG. 2, another structure comprising another wall is shown but instead of a window opening 15, a door opening 20 is provided in the wall, bounded by three channel shaped members 21, 22 and 23 which receive the edges of one or more of the panels to define the door opening 20.

Figure 3:
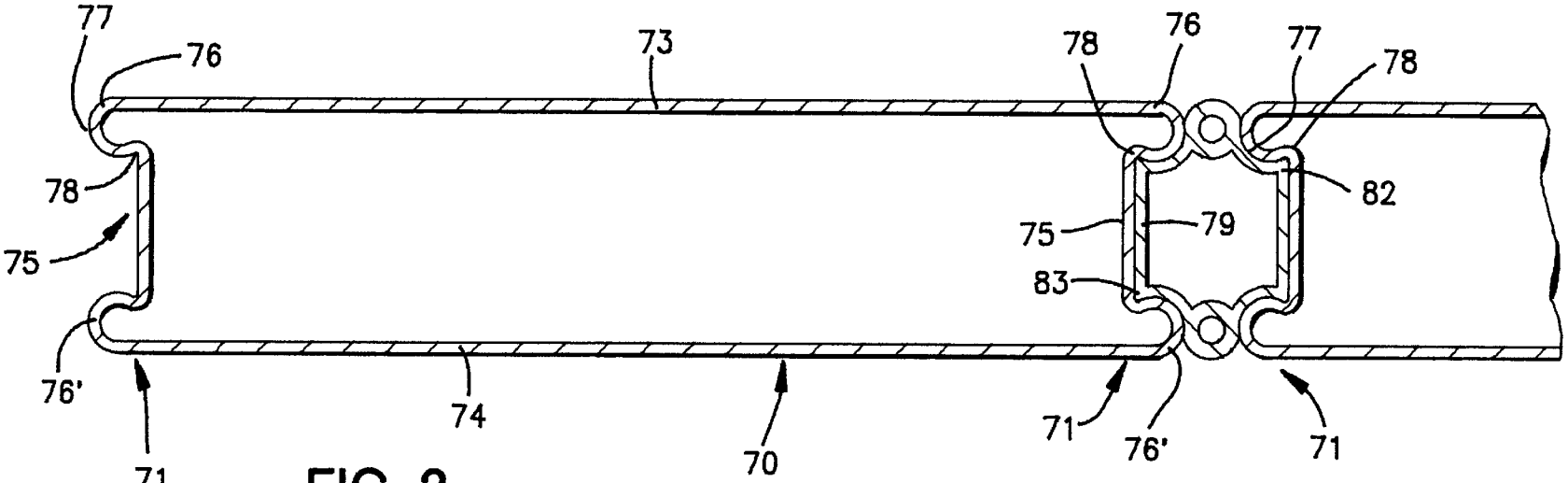
FIG. 3 is a transverse section of interlocking members of a structure in accordance with the invention.
Figure 3A:
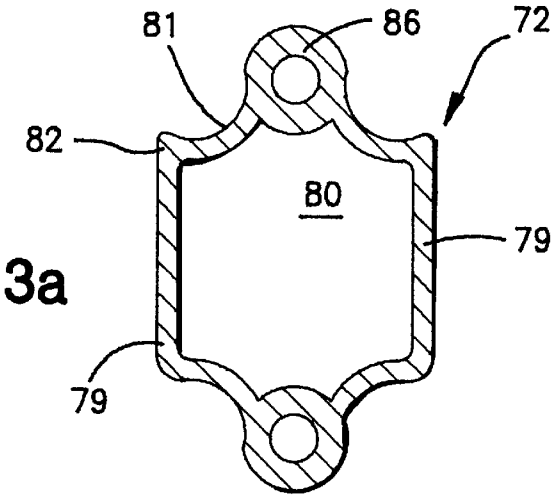
FIG. 3*a* shows one of the members of FIG. 3 in more detail.

Referring now to FIG. 3, panels 70 of identical construction and each having two identical location edges 71 are held together in an interlocked assembly by interposed connection members 72.

Each panel has an outer skin which provides a pair of faces 73, 74 and the location edges 71 are each of the type having an elongate recess 75 defined by the space between a pair of flange formations 76, 76' of identical shape. Each flange formation 76, 76' comprises a convex pivot shape formation 77 and an undercut zone 78.

Each connection member 72 (see FIG. 3) has a pair of tongue formations 79 which depend from a central zone 80, each tongue formation being adapted to be received in and to interlock with a panel location edge 71. For that purpose each tongue formation comprises a concave pivot bearing surface 81 for pivotal sliding movement over the convex pivot surface formation 77 of a panel edge 71, and an elongate protrusion 82 which is received in the undercut zone 78 of a panel edge 71.

In the assembled condition shown in FIG. 3 one of the pair of undercut zones 78, in flange formation 76, at a panel edge 71 is occupied by an elongate protrusion 82 whereas the other undercut zone 78, in flange formation 76', is unoccupied, leaving a small space identified by reference 83.

Figure 4:
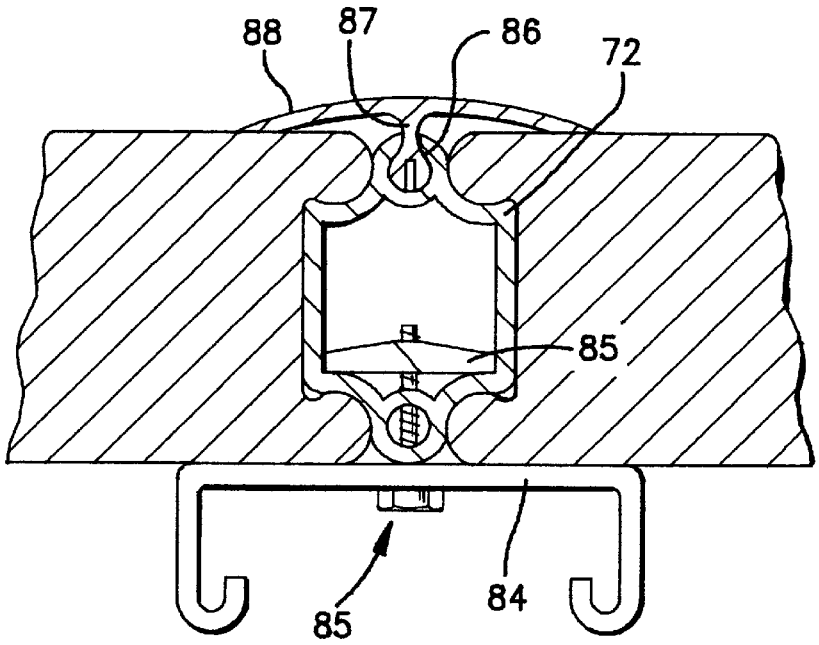
FIGS. 4, 5 and 6 are transverse sections of interlocking members in accordance with other embodiments of the invention.

The connection member 72 is hollow and can be used to locate a captive fixing device 85 (see FIG. 4) by means of which the member 72 may be secured to a support structure 84. That fixing arrangement may serve also as auxiliary retention means to maintain successive panels aligned in a co-planar configuration. The member 72 has a tubular side cavity 86 which is circular and can be closed as shown in FIG. 3 or may be slit as indicated in FIG. 4 to receive the support web 87 of a decorative cover strip 88.

Figure 5:
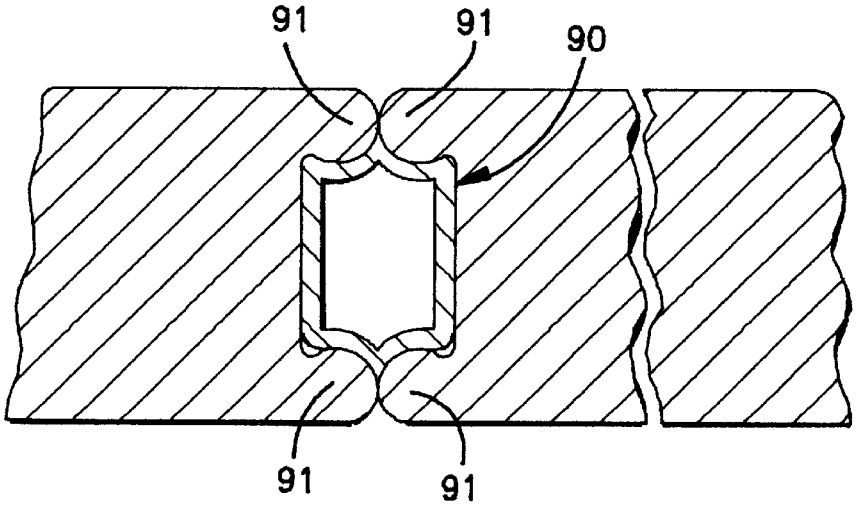

In the alternative construction of FIG. 5 a connection member 90 is of a narrow construction such that in the assembled condition confronting panel flange formations 91 come into abutting contact and the member 90 is concealed.

Figure 6:
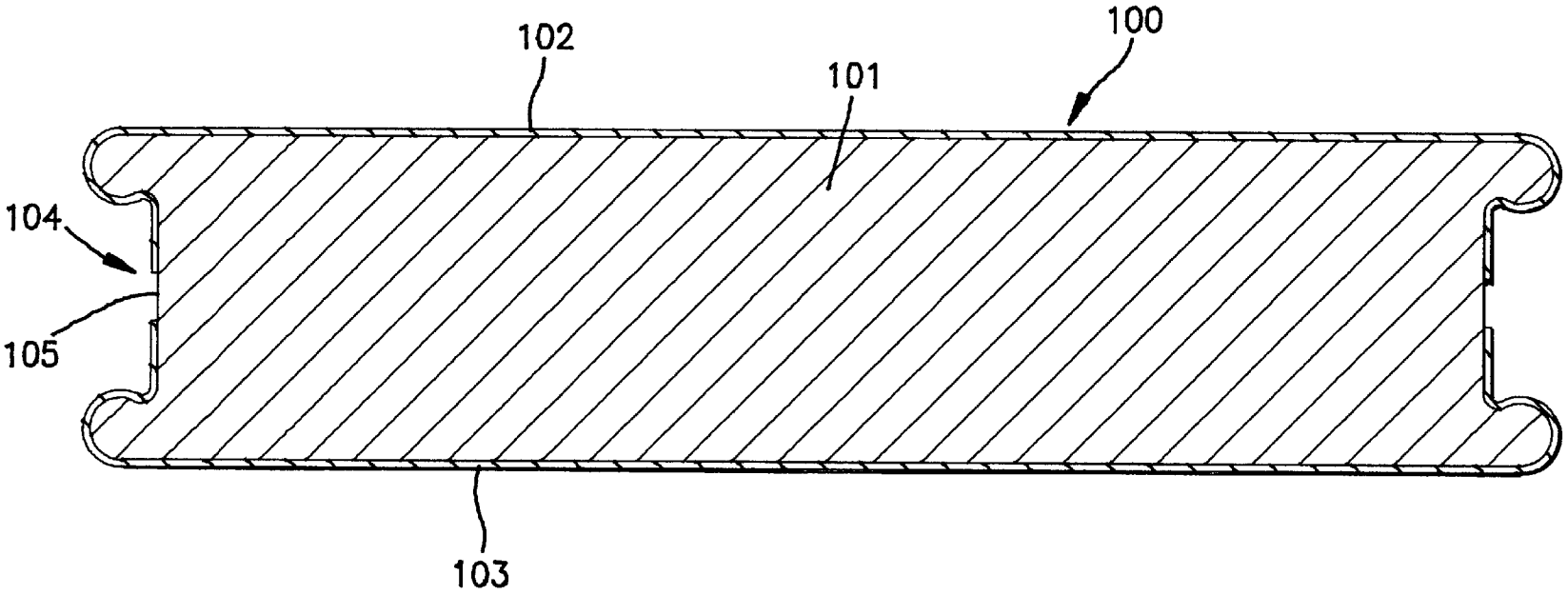

FIG. 6 shows a panel 100 of a construction which differs from that of FIG. 3 but can be interconnected in a similar manner by connection members 72.

The panel 100 differs in that it has a filling of polyurethane insulation foam 101 that is bonded to the outer skin material of the panel. The outer skin material is in two sections 102, 103 and these are spaced apart at the recess base regions 104. In consequence even if the skin sections are of a material that is a good conductor, the transfer of heat between opposite panel faces is advantageously impeded by the gaps 105 between the skin sections 102, 103.

I claim:

1. A structure comprising a first member having a first rectilinear location edge and a second member having a second rectilinear location edge which is interlocked with said first rectilinear location edge of the first member, the first rectilinear location edge comprising a pair of elongate flange formations which define therebetween an elongate recess, the length direction of the elongate formations and the recess being the length direction of the first rectilinear location edge, said second rectilinear location edge having a tongue formation which is located in said elongate recess by relative movement of the first and second members in a direction substantially perpendicular to the length direction of said elongate recess, and retention means to resist separation of the interlocked first and second rectilinear location edges in at least a first direction of separation, said structure comprising a plurality of said first members and a plurality of said second members with each second member arranged to lie interposed between and to interconnect two successive first members, each first member having a pair of first rectilinear location edges each comprising a pair of elongate flange formations, each second member having a pair of second rectilinear location edges each comprising a tongue formation, each of the flange formations of a pair at each said first rectilinear location edge comprising a longitudinally extending undercut zone, each tongue formation of each said second rectilinear location edge comprising a protrusion which is received in the undercut zone of one of said flange formations of a pair in an assembled condition of the members, and auxiliary retention means additional to said first and second members, said auxiliary retention means comprising a locking member arranged to extend transversely relative to said first and second members and interlock with an end of each of said first and second members thereby to retain the members in a selected position of angular alignment.

2. A structure according to claim 1 wherein a tension member extends longitudinally of the first and second members to hold the locking member interlocked with said ends of the first and second members.

3. A structure according to claim 2 wherein two locking members are provided and arranged respectively to lie interlocked with respective ends of the first and second members, said tension member extending between said locking members thereby to hold each of said locking members interlocked with ends of the first and second members.

* * * * *